US011219259B2

(12) United States Patent
Bassetto

(10) Patent No.: US 11,219,259 B2
(45) Date of Patent: Jan. 11, 2022

(54) BELT

(71) Applicant: Valentina Bassetto, Vermezzo (IT)

(72) Inventor: Valentina Bassetto, Vermezzo (IT)

( * ) Notice: Subject to any disclaimer, the term of this patent is extended or adjusted under 35 U.S.C. 154(b) by 0 days.

(21) Appl. No.: 16/608,017

(22) PCT Filed: Apr. 30, 2018

(86) PCT No.: PCT/IB2018/052972
§ 371 (c)(1),
(2) Date: Oct. 24, 2019

(87) PCT Pub. No.: WO2018/198098
PCT Pub. Date: Nov. 1, 2018

(65) Prior Publication Data

US 2021/0100303 A1 Apr. 8, 2021

(30) Foreign Application Priority Data

Apr. 28, 2017 (IT) ..... 102017000046708

(51) Int. Cl.
*A41F 9/00* (2006.01)
*A44B 11/22* (2006.01)

(52) U.S. Cl.
CPC ..... *A41F 9/002* (2013.01); *A44B 11/22* (2013.01)

(58) Field of Classification Search
CPC ..... A41F 9/002; A44B 11/22
See application file for complete search history.

(56) References Cited

U.S. PATENT DOCUMENTS 322,087 A * 7/1885 Basinger ..... A44B 11/22 24/176
970,184 A * 9/1910 Conway ..... A44B 11/04 24/309
1,738,477 A * 12/1929 Kerngood ..... A44B 11/04 24/186
2,192,640 A * 3/1940 Fields ..... A44B 11/22 24/176

(Continued)

FOREIGN PATENT DOCUMENTS

FR 2 537 851 A1 6/1984

OTHER PUBLICATIONS

The Italian Search Report for IT201700046708, 2 pages, completed Jan. 11, 2018.

(Continued)

*Primary Examiner* — David M Upchurch
(74) *Attorney, Agent, or Firm* — Vorys, Sater, Seymour & Pease

(57) ABSTRACT

A belt is provided including a buckle and a strap, the buckle defining an inner and an outer area and including a hollow support including two side bars and an inner bar, wherein the side bars include abutment surfaces protruding towards the inner area and wherein the inner bar includes a non-movable tooth, protruding towards the outer area and including a head and a stem, wherein the head is located at the free end of the tooth and is larger than the stem. The strap defines a first and a second end, wherein the first end is connected to the buckle, the second end includes at least one non-through hole. The tooth is configured to be engaged to the non-through hole by means of the head when the strap is closed in a loop.

7 Claims, 2 Drawing Sheets

(56) References Cited

U.S. PATENT DOCUMENTS

| | | | | | |
|---|---|---|---|---|---|
| 2,884,675 | A * | 5/1959 | Sternschuss | A44B 11/22 | 24/163 R |
| 3,685,057 | A * | 8/1972 | Foy | A44B 11/22 | 2/325 |
| 3,748,700 | A * | 7/1973 | Willey | A43C 11/06 | 24/172 |
| 3,999,251 | A * | 12/1976 | Payant | A41F 9/002 | 24/7 |
| 4,422,219 | A * | 12/1983 | Kepiro | A44B 11/22 | 24/176 |
| 7,617,801 | B2 * | 11/2009 | Wang | A01K 27/001 | 119/863 |
| 8,429,798 | B1 * | 4/2013 | Paigen | A44B 11/22 | 24/176 |
| 10,039,350 | B2 * | 8/2018 | Lo | A44B 11/22 | |

OTHER PUBLICATIONS

The International Search Report for PCT/IB2018/052972, 2 pages, dated Aug. 6, 2018.

* cited by examiner

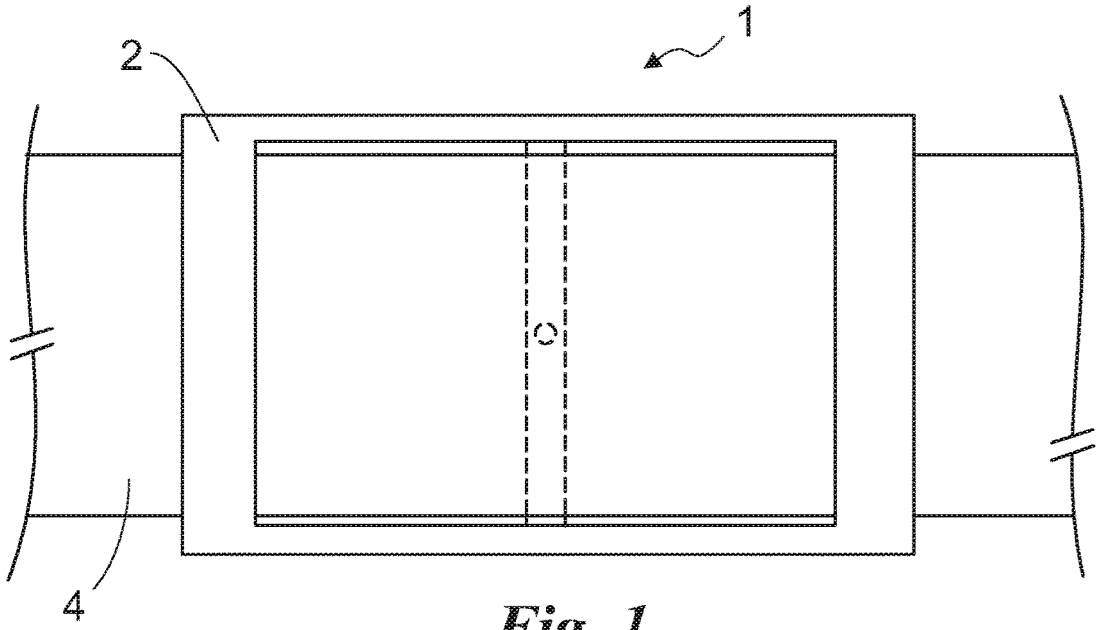
*Fig. 1*
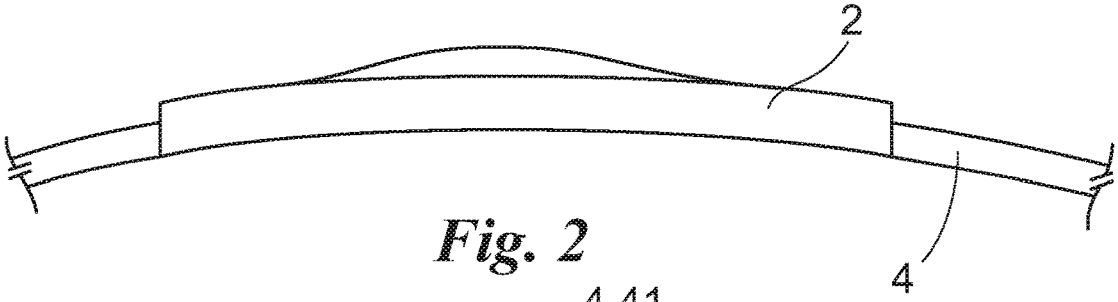
*Fig. 2*
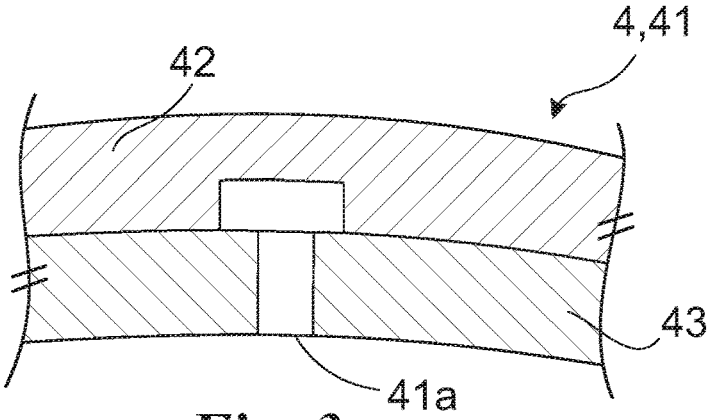
*Fig. 3a*
*Fig. 3b*
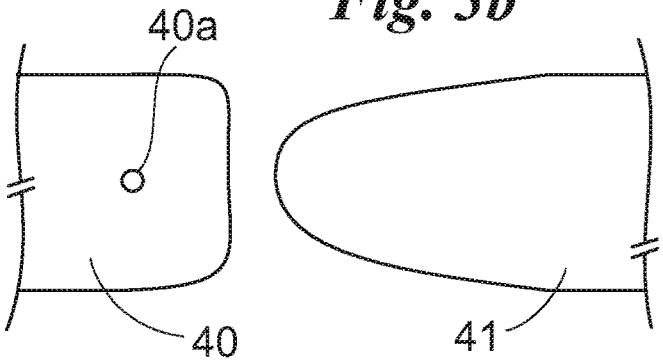

BELT

The present invention relates to a buckle for a belt of the type as recited in the preamble of the first claim.

As known, belts are very popular in the daily life of everyone. Generally, such item of clothing has the function of tightening a body inside it and therefore is generally used to tighten a dress or hold trousers at the chosen waist height or may have a purely aesthetic function.

There are various types of belts, currently marketed, which differ mainly for the type of buckle present.

Among the known buckles are classic or prong buckles, those with a clasp, those with small spherical prong and quick release.

The classic buckle has an open quadrangular structure in which at least one portion is bound or glued or sewn or trapped inside a loop formed by the belt. Also inside the quadrangular frame is a tooth, better known as a prong, suitable to be trapped inside the holes present in the belt on the opposite end to the end engaged to the buckle.

The clasp structure allows instead the free end of the belt to be trapped inside a variable section portion that can be restricted by closing the front portion of the buckle in a snap or lever effect.

The small spherical prong structure is instead typically composed of a fixed or movable prong at the end of which there is a small sphere; this sphere is suitable to engage the holes on the free end of the belt in the manner of a "button".

Lastly, the quick-release structure is less common for belts and more used for objects such as backpacks or pouches or other travel accessories.

The latter is characterized by two portions, generally polymeric, that engage in reversible elastic deformation or by a double engagement slot in which the free end of the belt is engaged.

The prior art described has several significant drawbacks.

In particular, standard belts are subject to heavy wear since the central prong, fully engaging the holes of the free end of the belt, deforms the belt, over time deforming or ripping the material.

In addition, the central prong, being hinged centrally, as also the elastic polymer parts, is also subject to wear. It may, over time, tend to move away form the centre with additional wear of the belt material.

Another disadvantageous aspect of the belts mentioned is the method of engagement of the belt with the buckle. In particular, loops are generally made on one end of the belt so as to engage at least one side of the quadrilateral or frame generated by the buckle.

This loop is made by folding the belt and subsequent nailing or gluing or stitching the two ends forming the loop. Alternatively, the belt may be directly attached to the buckle for example with one or more of the methods mentioned.

These types of constraint create problems, in the long run, on the belt seal, which may easily deteriorate.

Lastly, another disadvantage of the current state of the art is that the known structures are aesthetically not effective especially given the wear to which they are subjected.

In addition, classically designed belts do not allow the colour or type of strap constituting the belt to be easily varied.

Some of these drawbacks are partially solved by the patent applications U.S. Pat. No. 2,884,675 and FR-A-2537851, but most of them remain unresolved or partially resolved.

In this situation, the technical purpose of the present invention is to devise a belt able to substantially overcome at least some of the drawbacks mentioned.

Within the sphere of said technical purpose, one important aim of the invention is to obtain a belt that limits the wear of the components making up both the buckle and the belt or perforated belt engaging in the buckle.

Another important purpose of the invention is to make a belt in which the buckle and belt are easily functionally engaged to each other.

In conclusion, a further object of the invention is to make a belt which makes it possible to maximise the aesthetic aspects and which makes it possible to easily vary the strap constituting the structure.

The technical purpose and specified aims are achieved by a belt as claimed in the appended claim 1. Examples of preferred embodiments are described in the dependent claims.

Preferred embodiments are described in the dependent claims.

The characteristics and advantages of the invention are clearly evident from the following detailed description of preferred embodiments thereof, with reference to the accompanying drawings, in which:

FIG. 1 shows the belt according to the invention;

FIG. 2 shows a side view of the belt;

Figure 4:
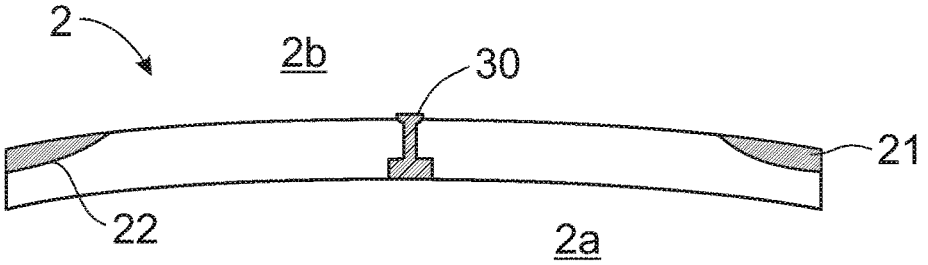
Figure 5:
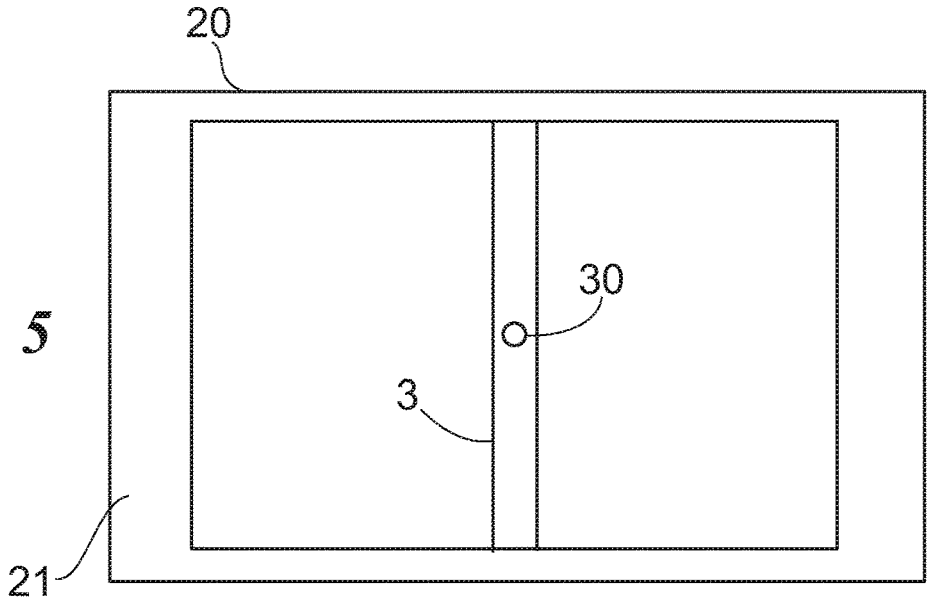

FIG. 3*a* is a side view in cross-section of the second end of the strap;

FIG. 3*b* shows the ends of the strap;

FIG. 4 shows a side view in cross-section of the buckle;

FIG. 5 illustrates the buckle seen from above; and

Figure 6:
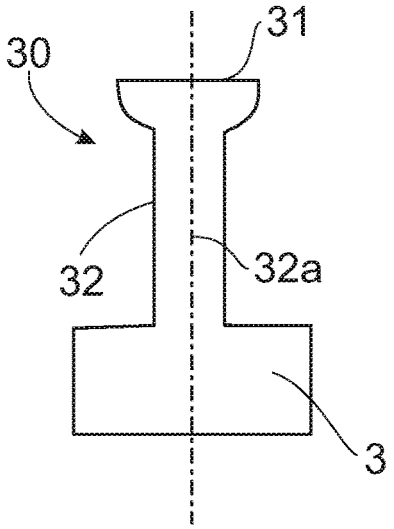

FIG. 6 shows in detail the prong of the inner bar;

Herein, the measures, values, shapes and geometric references (such as perpendicularity and parallelism), when used with words like "about" or other similar terms such as "approximately" or "substantially", are to be understood as except for measurement errors or inaccuracies due to production and/or manufacturing errors and, above all, except for a slight divergence from the value, measure, shape or geometric reference which it is associated with. For example, said terms, if associated with a value, preferably indicate a divergence of not more than 10% of said value.

In addition, where used terms such as "first", "second", "upper", "lower", "main" and "secondary" do not necessarily refer to an order, a priority relationship or relative position, but may simply be used to more clearly distinguish different components from each other.

The measurements and data presented herein are to be considered, unless otherwise indicated, as made in Standard International Atmospheres ICAO (ISO 2533).

With reference to said Drawings, reference numeral 1 globally denotes the belt according to the invention.

The belt 1 comprises a buckle 2 and a strap 4.

The buckle 2 defines, as usual, an inner area 2*a* and an outer area 2*b*.

The inner area 2*a* is substantially defined by the area suitable to adhere to the surface of a body such as, for example, the waist of a user wearing the belt.

The outer area 2*b*, therefore, is defined by the opposite area to the inner area 2*a* and is, for example, the area accessible to a user's view.

The buckle 2 comprises then a support 20.

The support 20 is for example a hollow frame defined by an outer frame and an inner through cavity. In addition, the support 20 may have a rounded, square or other shape.

Preferably, the support 20 comprises two side bars 21 and an inner bar 3.

The side bars 21 are for example part of the frame and preferably are substantially parallel to each other. Preferably, the inner bar 3 is also substantially parallel to the side bars 21.

In particular, the inner bar 3 occupies, at least in part, the cavity of the support 20 and subdivides for example the cavity described by the outer frame into two smaller, distinct cavities.

Preferably, the support 20 is a substantially rectangular quadrilateral outer frame in which two parallel opposite sides comprise the aforementioned side bars 21.

The bars 21, 3 may also be a cylindrical shape, or substantially parallelepiped shape at the base, e.g. rectangular or square.

In addition, preferably, the side bars 21 and the inner bar 3 are suitable to house on their surface at least part of a strap 4.

In particular, the side bars 21 are suitable to adhere to the strap 4 at their lower surface. The term lower surface is understood to mean the surface facing the inner area 2*a*.

Conversely, the inner bar 3 is suitable to adhere to the strap 4 at a part at least of its upper surface, wherein the term upper surface means the surface facing the outer area 2*b*.

Preferably, the side bars comprise abutment surfaces 22 protruding towards the inner area 2*a*.

In detail, preferably, the abutment surfaces 22 protrude towards the inner area 2*a* and define convex, curved surfaces. In particular, the abutment surface 22 approaches the inner area 2*a*, or thickens as it moves away from the cavity defined by the support 20.

The inner bar 3 is preferably arranged, as said, inside the cavity defined by the support 20.

In particular, the inner bar 3 is connected along at least one end to the support 20. Preferably, the inner bar 3 is equidistant from the side bars 21. Thus, the inner bar 3 occupies substantially a central area and divides, for example, the cavity into two smaller cavities of equal shape and extension.

In addition, the inner bar 3 comprises a tooth 30.

The tooth 30 comprises for example a head 31 and a stem 32.

In particular, the stem 32 is preferably connected to the surface of the inner bar facing the outer area 2*b*. Furthermore, preferably, the stem 32 protrudes substantially in a straight line towards the outer area 2*b* and thereby defines a central axis 32*a*.

The stem 32 may have a conical or square parallelepiped shape, however preferably the stem 32 is a cylinder, the axis of which coincides with the central axis 32*a*.

The head 31 is preferably arranged at the free end of the tooth 30. Furthermore, head 31 is substantially larger than said stem 32 considering the cross-sections in a plane perpendicular to the central axis 32*a*.

In particular, preferably, the head 31 is substantially disc-shaped and therefore has a larger diameter than the base diameter of the stem 32.

More in detail the diameter of the head is, for example, greater by a percentage of 30% to 50% than the size of the stem 32.

In a preferred configuration, the stem 32 has a diameter of about 2 mm and height equal to 4.5 mm. In addition, preferably, the head 31 has a diameter of 3 mm and a height equal to 0.5 mm.

Connectors may also be provided between the head 31 and the stem 32.

Alternatively, the head 31 may have a truncated-cone shape converging towards the stem 32.

The tooth 30 may also be arranged on the inner bar 3 in separate spaces, but preferably the tooth 30 is arranged in a centred position both relative to the inner bar and to the entire support 20.

In the preferred configuration, the support 20 is between 30-40 mm and 65-75 mm. Moreover, in a view from above (FIG. 5) the side bars 21 preferably have a width of 8-10 mm, while the inner bar 3 has a width of 4-6 mm.

Preferably, the support 20 has, in addition, a thickness, visible in a side view (FIG. 2) of 5-10 mm. The support 20 may thus be straight along the thickness, or curved as desired.

Preferably, the support 20 has a curvature angle of between 3° and 7°.

The strap 4 instead comprises a first end 40 and a second end 41.

The first end 40 in particular is connected to the buckle 2.

The constraint may be detachable or permanent. For example, the first end 40 may be connected by gluing to the buckle 2. Alternatively, the buckle 2 may have additional side bars of the known type and the strap 4 may engage the bars forming loops of the known type. For example, a portion of the strap 4, in the first end 40, may be rolled up and the edges that form the engagement loop may be connected by sewing, gluing or connected by screws or nails.

Preferably, the first end 40 comprises a through-hole 40*a*. Such through-hole 40*a* is suitable to engage the tooth 30 of the buckle 2 so as to form a coupling that defines a detachable constraint.

Thus, for example, the through hole 40*a* has dimensions compatible with the tooth 30.

The second end 41 comprises, instead, preferably at least one non-through hole 41*a*. The non-through hole 41*a* is, in particular, suitable to engage the tooth 30.

More in detail, the tooth 30 is suitable to be engaged with said non-through hole 41*a* by means of the head 31 when said strap 4 is closed in a loop, for example since in use.

Preferably, therefore, the non-through hole 41*a* is substantially counter-shaped to the tooth 30.

Lastly, the belt 4 preferably comprises a first layer 42 and a second layer 43 which make up its thickness.

Both layers 42, 43 are between 3-5 mm in size and at least one of the two layers 42, 43 comprises bull leather. The two layers are sewn to each other along the edges.

The remaining layer preferably includes a type of leather chosen from those known to the current state of the art.

Advantageously, the non-through hole 41*a* may be made in two portions, a first portion 41*b* in the first layer 42, preferably cylindrical with a constant diameter and suitably counter-shaped to the stem 32, a second portion 41*c* in the second layer 43 preferably also cylindrical and of a diameter greater than the first and suitably counter-shaped to the head 31.

Alternatively, only the first portion 41*b* counter-shaped to the stem 32 is present. In this variant, the head 31 can find space between the two layers 42 and 43, which are mutually separable since at a distance from the edge seams.

The functioning of the belt 1 described above in structural terms, is as follows.

A user can compose the belt 1 as he wishes.

Once a strap 4 has been chosen as described it can be engaged to the tooth 30 by means of the through hole 40*a*.

After which, once the strap 4 has been closed to prepare it for use by the user, the second end may be made to pass partially inside the cavity defined by the support 20 so as to rest in part below the abutment surfaces 22 defined by the side bars 21, and partly above the tooth 30 included in the inner bar 3.

After engaging one of the non-through holes 41*a* on the tooth 30, the belt 1 is connected and functioning.

The belt 1 according to the invention achieves important advantages.

In fact, the belt limits the wear of the components making up both the buckle and the strap engaged in the buckle. The type of coupling between the first end and buckle, as well as the absence of elements such as the rotating prong, makes the structure of the belt simplified and less prone to the wear typical of conventional belts.

Furthermore, even in the presence of wear, on the belt 1 there are no visible signs of the typical deformations present on prong belts, both fixed and movable, which cause evident buckling on the skin or leather constituting conventional belts.

A further advantage of the belt 1 is that the buckle and belt are easily connectable to each other. The type of connection makes it possible to make the belt, starting from the separate components, in a very rapid but in any case functional manner.

This feature also makes it possible to change easily the type of strap 4 comprised in the belt 1. For example, it may be easy to use a strap 4 of a different colour since each connection of the belt 1 is easy to undo, it being necessary to merely remove the tooth 30 from the holes 40*a*, 41*a*.

In conclusion, a further advantage of the invention is that the possibility of varying the strap 4 and the reduced wear maximizes and enhances the aesthetic aspects of the belt 1, which result in it having a longer life than the conventional belts present in the current state of the art.

Variations may be made to the invention described herein without departing from the scope of the inventive concept defined in the claims.

For example, the nominal size of the buckle may differ since the same may be used for items other than a belt such as, for example, shoes, for decorative or other purposes.

In said scope all the details may be replaced with equivalent elements and the materials, shapes and dimensions may be as desired.

The invention claimed is:

1. A belt comprising a buckle and a strap, said buckle defining an inner area and an outer area and comprising a hollow support, said support comprising two substantially parallel side bars and an inner bar substantially parallel to said side bars, said side bars comprising abutment surfaces protruding towards said inner area, said inner bar comprising a fixed tooth protruding towards said outer area, wherein said abutment surfaces define convex curved surfaces, said tooth comprises a head and a stem defining a middle axis, said head being arranged on a free end of said fixed tooth and being larger than said stem in a plane perpendicular to said middle axis, the strap defining a first and a second end, wherein said first end is secured to said buckle, said second end comprises at least one non-through hole and said tooth is configured to engage with said non-through hole by means of said head when said strap is closed in a loop.

2. The belt according to claim 1, wherein said inner bar lies at the same distance from said side bars.

3. The belt according to claim 1, wherein said stem is cylindrical and said head is substantially disc-shaped, said head having a larger diameter than a base diameter of said stem in a percentage in the range between 30% and 50% of said base diameter of said stem.

4. The belt according to claim 1, wherein said support is a substantially rectangular frame in which two parallel, opposite sides comprise said side bars.

5. A strap defining a first and a second end and a buckle, said first end being secured to a buckle, said buckle comprising at least one tooth which comprises a head and a stem defining a middle axis said head being arranged on a free end of said at least one tooth and being larger than said stem in the plane perpendicular to said middle axis, wherein said second end comprises at least one non-through hole, wherein said at least one tooth is configured to engage with said non-through hole by means of said head when said strap is closed in a loop, wherein said first end comprises a through hole suitable to engage said at least one tooth of said buckle, the coupling between said through hole and said tooth defining a removable secured connection.

6. The strap according to claim 5, comprising a first layer and a second layer, each having dimensions of between 3 and 5 mm and at least one of the first and second layers comprising bull leather.

7. The strap according to claim 5, wherein said non-through hole is counter-shaped with respect to said at least one tooth.

* * * * *